United States Patent [19]

Day

[11] Patent Number: 4,828,122

[45] Date of Patent: May 9, 1989

[54] HANGROD SYSTEM

[75] Inventor: Joel Day, Elk Grove Village, Ill.

[73] Assignee: Capitol Hardware Mfg. Co., Inc., Chicago, Ill.

[21] Appl. No.: 154,414

[22] Filed: Feb. 10, 1988

[51] Int. Cl.[4] ..... A47H 1/02

[52] U.S. Cl. ..... 211/105.1; 248/243; 248/251

[58] Field of Search ..... 248/221.2, 243, 251; 211/105.1, 123, 103; 256/65; 403/254, 255

[56] References Cited

U.S. PATENT DOCUMENTS

| | | | |
|---|---|---|---|
| 1,394,287 | 10/1921 | Denning | 211/123 |
| 1,692,059 | 11/1928 | Starner | 211/123 |
| 3,239,070 | 3/1966 | Clauson | 211/105.1 |
| 3,269,553 | 8/1966 | Ruhnke | 211/105.1 |
| 3,282,548 | 11/1966 | Ruhnke | 248/243 |
| 3,286,850 | 11/1966 | Ruhnke | 211/105.1 |
| 3,288,308 | 11/1966 | Gingher | 211/123 |
| 3,664,511 | 5/1972 | Fenwick | 211/105.1 |
| 3,990,582 | 11/1976 | Schindel | 248/251 |
| 4,316,547 | 2/1982 | Varon | 211/124 |

FOREIGN PATENT DOCUMENTS

| | | | |
|---|---|---|---|
| 574808 | 4/1959 | Canada | 248/243 |
| 1002002 | 12/1976 | Canada | 248/243 |
| 2133684 | 8/1984 | United Kingdom | 211/103 |

*Primary Examiner*—J. Franklin Foss
*Assistant Examiner*—Robert A. Olson
*Attorney, Agent, or Firm*—Russell E. Hattis; Daniel N. Christus

[57] ABSTRACT

A hangrod system, suspended from one or more generally vertically disposed standards having a plurality of vertically spaced bracket support apertures, comprising one or more brackets, each preferably having a tubular main body portion supported by and extending horizontally from a standard. At the rear end of each bracket body portion is a preferably plate-like, hook-forming insert member which interfits with one or more of the slots in the standard. The front end of each of the brackets includes means, such as a vertically oriented plate-like support member with an upwardly extending tongue, which fills the corresponding interior space of either a tubular hangrod which interfits therewith, or a stop member when the bracket is to form a hangrod, for hanger-supported garments. The hangrod or stop member has a suitable slot to permit the tongue portion of the support member to interfit therewith. The margins of the body portion of the bracket and the hangrod or stop member preferably are in alignment to provide an attractive assembly.

11 Claims, 2 Drawing Sheets

FIG. 8
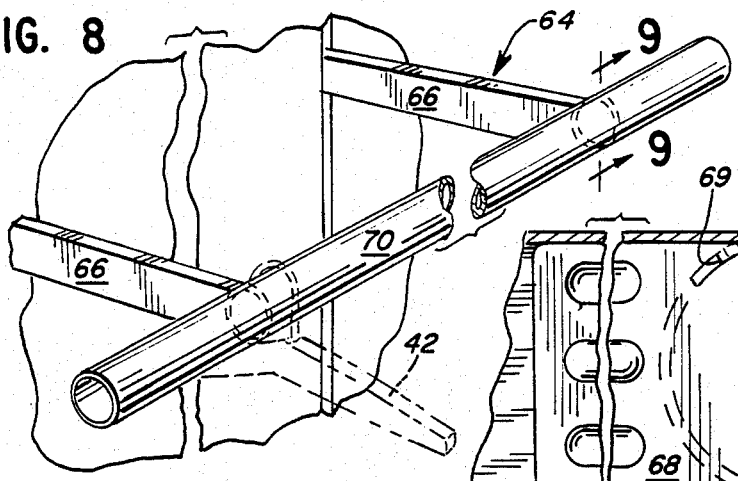
FIG. 9
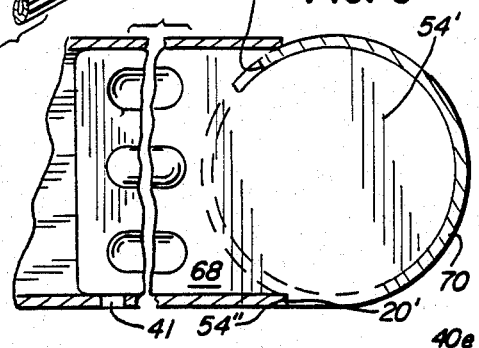
FIG. 10
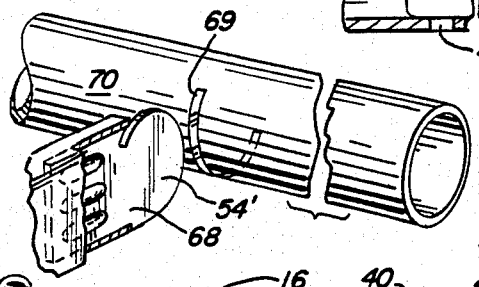
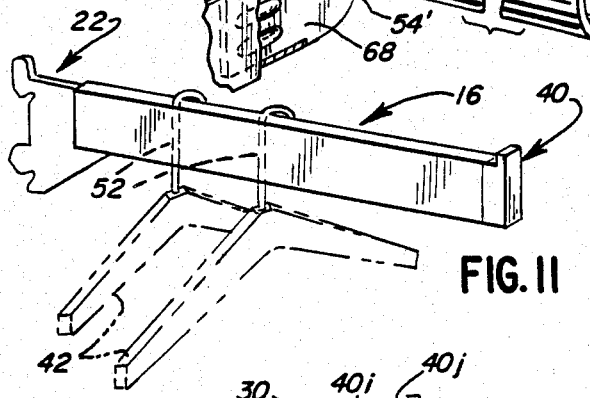
FIG. 11
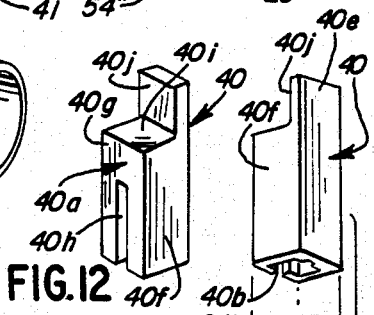
FIG. 12
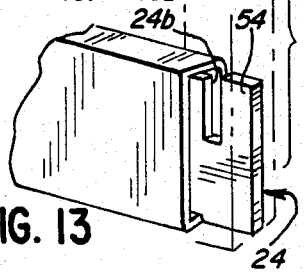
FIG. 13
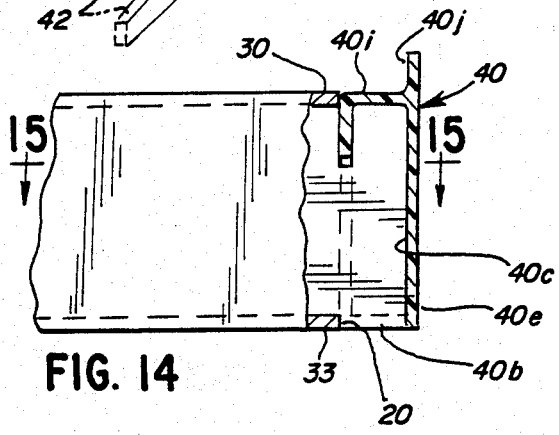
FIG. 14
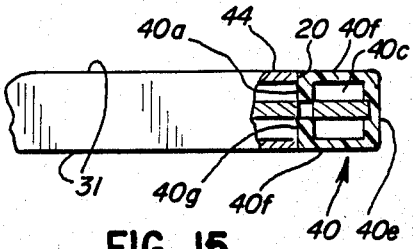
FIG. 15

HANGROD SYSTEM

Description

1. Technical Field

This invention relates generally to hangrod systems of the type generally found in the clothing sections of retail, discount, and wholesale stores, which systems are suitable for hanging and neatly displaying clothes on conventional hangers.

2. Background of the Invention

Hangrod systems for the hanging and displaying of clothes in retail and wholesale outlets and department stores are well-known, and available in many different forms and styles. Generally, such hangrod systems are available in permanently fixed or welded forms, or alternatively in readily assembled or disassembled forms. Both the permanently fixed and assembled or "knock-down" forms of these hangrod systems may comprise a set of brackets, one or more standards secured to a supporting wall, and a hangrod secured to the brackets and on which garment-supporting hangers are placed for display.

In the permanently fixed or welded forms, there is no need for hardware for securing the hangrod to the brackets; in contrast, the assembled forms of hangrod systems require such hardware. These latter forms of hangrod systems have the advantage of versatility. For example, two brackets may be inserted into two horizontally spaced-apart standards to support a hangrod of a given length. Alternatively, three or more brackets may be inserted into three or more horizontally spaced-apart standards to support a longer hangrod.

Two of these assembled hangrod systems are shown in U.S. Pat. Nos. 3,282,548, issued to R. R. Ruhnke on Nov. 1, 1966, and 4,316,547, issued to D. S. Varon on Feb. 23, 1982. As may be seen from a review of FIGS. 1–3 of the Ruhnke patent, the brackets supporting the hangrod are of a generally upwardly curved shape. Thus, when viewed from the front, the unattractive brackets as well as the hangrod are visible to the observer. Moreover, the brackets of Ruhnke are rather thin, and the ends thereof abut respectively against the hangrod and against the supporting standard along single narrow lines of contact. Thus, the Ruhnke brackets do not provide a substantial bracing support to minimize pivoting tendencies of both the brackets on the standard, and the hangrod on the brackets. Also, the thin plate-like appearance of these brackets is unattractive.

FIG. 1 of the Varon patent shows that the front or distal end 12 of its support bracket 14 also extends beyond the front face of the bar 10 or hangrod. Thus, it is again readily apparent that an observer can also see a projecting portion of the bracket 14 when viewing the Varon hangrod system from the front thereof. Accordingly, the Ruhnke and Varon constructions provide for a somewhat visually cluttered unaesthetic appearance.

SUMMARY OF THE INVENTION

The invention has its most important application to hangrod systems suspended from a plurality of generally vertically disposed standards, each having a plurality of vertically spaced bracket support slots. It preferably includes brackets which, in the system's assembled form, are supported by and extend generally horizontally from the standards. At the rear end of each bracket are means, such as a hook-forming plate-like means, for removably interfitting with one or more of the slots in the standard. The front end of each bracket includes means, such as a plate-like support means, formed by an upstanding tongue interfitting with either a hangrod or a stop member to be described, when the bracket itself serves as a hangrod. The hangrod and stop member include means, such as slots and passageways, which interfit with the tongue on the front end of the bracket, permitting its easy removal from or interengagement with the front end of each support bracket.

In accordance with a feature of the invention, the various components of this knock-down hangrod system are so dimensioned and constructed that when the brackets are supported in a stable manner on the standards, and the entire assembly is viewed from the front and at a distance, the uppermost and bottommost margins of the hangrod or stop member obscure the brackets from view. While this advantage has been achieved before in pre-assembled, welded hangrod systems, it is unique in "knock-down" hangrod systems where the individual parts can be assembled and disassembled or re-arranged as desired.

To facilitate these features of the invention, it is preferred that each bracket be constructed so as to have a substantial width so as not to appear like a thin plate-like member. To this end, the main body portion of each bracket preferably has a tubular configuration, such as a rectangular tubular configuration, although the use of a cylindrical tubular hangrod will be shown. The size of the hangrod preferably approximates that of the main body portion of each bracket. The front and rear ends of the main body portion of each bracket are adapted, preferably, to either make face-to-face contact or be contiguous with the front face of a standard and the rear face of the hangrod. This greatly facilitates the stability of the entire hangrod system and renders it more attractive when it is viewed at an angle where the brackets are visible. However, the brackets are not normally visible when viewed from a distance at the front of the hangrod system.

The main body portion of each bracket preferably has inserted into and anchored to the rear end thereof a vertically oriented plate-like member forming one or more hooks which interengage with the slots at the front of each standard. There is inserted and anchored, in the front end of each bracket main body portion, a vertically oriented plate-like member having on the front thereof, an upstanding tongue of a shape to fill the interior of the tubular hangrod involved. The hangrod has at the rear and/or bottom thereof suitably spaced tongue-receiving slots where it is to be supported on the front of a bracket. The hangrod is preferably positioned by dropping it into place over the tongues on the front ends of the supporting brackets involved.

When the hangrod described is not desired, and the bracket is to form a hangrod in its own right, a stop member to be described, which has margins preferably forming extensions of the margins of the bracket, is fittable upon the tongue projecting from the front of each bracket.

BRIEF DESCRIPTION OF THE DRAWINGS

FIG. 8 is a perspective view, partially in section, of a second embodiment of the hangrod system of the invention in its assembled state, where the hangrod is a cylindrical tubular member;

FIG. 9 is a vertical sectional view, taken along line 9—9 of FIG. 8, of the hangrod system there shown at a point along the hangrod where it is supported on a bracket;

FIG. 10 is an exploded, perspective view, partially in section, of the front end of the bracket shown in FIG. 9 where the upstanding tongue thereof is opposite a slot of the hangrod which is positioned to be pushed and dropped onto the tongue;

FIG. 11 is a perspective view of a different hangrod system which can be formed from one of the brackets shown in the hangrod system of FIGS. 1–7, and a stop member which is mountable over the front end of the main body portion of the bracket;

FIG. 12 is a perspective view of the stop member shown in FIG. 11;

FIG. 13 is an enlarged, exploded, perspective view of the front end of the bracket shown in FIG. 11 and the stop member;

FIG. 14 is an enlarged, side view, partially in section, of the front end of the bracket shown in FIGS. 11 and 13 and the stop member assembled therewith: and FIG. 15 is a top view, partially in section, taken along section line 15—15 of FIG. 14, of the structure shown in FIG. 14.

DETAILED DESCRIPTION OF THE PREFERRED EMBODIMENT

Figures 1, 2, 3, 4, 5, 6, 7:
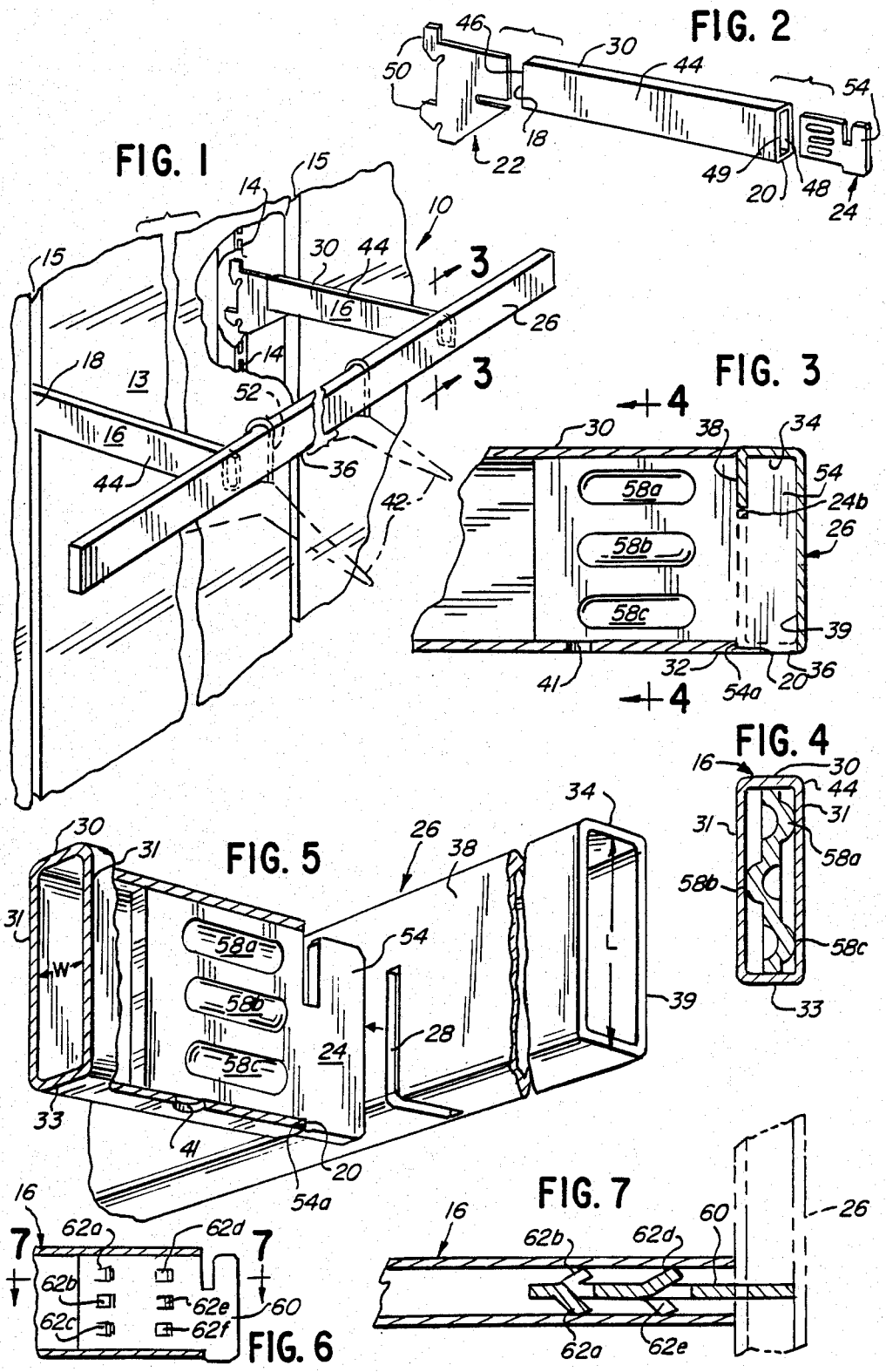
FIG. 1 is a perspective view, partially broken away, of one embodiment of the hangrod system in accordance with the invention in its assembled state where the hangrod is a rectangular tubular member.
FIG. 2 is a perspective, exploded view of one of the brackets of FIG. 1.
FIG. 3 is a fragmentary vertical sectional view, taken along section line 3—3 of FIG. 1, where one of vertically oriented, plate-like support members is located.
FIG. 4 is a transverse sectional view, taken along section line 4—4 of FIG. 3.
FIG. 5 is an exploded, perspective view, partially in section, of the plate-like support member in the front of the main body portion of the bracket, and the hangrod which fits over and onto the tongue of the plate-like support member.
FIG. 6 is side view, partially in section, of the front of the main body portion of a bracket, into the front aperture of which is inserted an alternative plate-like support member.
FIG. 7 is a horizontal, sectional view, taken along section line 7—7 of FIG. 6, of the main body portion of the bracket and alternative plate-like support member shown therein.

While this invention is susceptible of many different forms, there is shown in the drawings and will herein be described in detail most preferred embodiments of the invention. It should be understood that the present disclosure is to be considered as an exemplification of the principles of the invention, and it is not intended to limit the broadest aspects of the invention to the embodiment or embodiments illustrated, although they form specific preferred aspects thereof.

Referring now to the drawings, FIG. 1 shows one of the preferred embodiments in accordance with the invention in its fully assembled form. The hangrod system 10 there shown includes a plurality of well-known, conventional standards 12, preferably made of steel or other suitable, relatively strong material. In their assembled form, these standards 12 are generally vertically disposed and may be secured to a wall of other suitable stable surface. For cosmetic or aesthetic reasons, these standards 12 are generally obscured from view by means of panels 13 or the like, which are interrupted by narrow gaps 15 permitting access to the standards 12.

Each of the standards 12 includes a plurality of vertically spaced support slots 14. By providing a plurality of these vertically spaced slots 14, as shown in the cutaway portion of FIG. 1, the user of the hangrod system 10 can change the vertical location of its other structural components to both accommodate clothes of differing lengths and permit the user to arbitrarily alter the overall height of the system.

A pair of brackets 16 is provided in the hangrod system shown in FIG. 1. Each of the brackets 16 is preferably made of a heavy-gauge steel, such as 11 gauge. The portions of each bracket 16 visible from a side view of the system preferably have an even height with parallel, horizontal top and bottom surfaces when supported from a standard. The bracket 16 has a preferably rectangular tubular main body portion 44 which forms these visible portions of the bracket. It has a substantial height and width so that it looks like a substantial structural and aesthetically pleasing element of the system. Certain mechanical advantages, to be discussed below, also accrue from this configuration, as compared to these plate-thin brackets.

Referring now to FIG. 2, the main body portion of each bracket 16 has a vertical rear end 18 and a vertical front end 20. Bracket support means 22 are provided at the rear end 18 of each of the brackets 16, these means permitting the brackets to be removably inserted into any desired pair of support slots 14 in its respective standard 12. In this embodiment, the means comprises a vertically oriented plate-like support member 22, which has a rectangular horizontally extending front portion 23 inserted into an aperture 46 at the rear end 18 of the bracket 16 and welded thereto. When the plate-like support member 22 is anchored in place, the bracket 16 attached to member 22 may be removably inserted into a pair of standard support slots 14 by means of a pair of hook-forming projections 50 integral with this member 22. These projections then support the bracket 16 in a substantially perfect horizontal orientation depicted in FIG. 1, with the vertical end 18 of the main body portion 44 of the bracket preferably contacting or closely contiguous to the vertical front face of the supporting standard. The horizontal bracket 16 can then stably support the necks 52 of garment-supporting hangers 42, if a hangrod system like that shown in FIGS. 11–15 is to be formed thereby.

Hangrod or stop member support means 24 are provided for removably inter-fitting with a preferably rectangular tubular hangrod 26, or with a cap and stop member 40 to be described and as shown in FIGS. 11–15. In the hangrod system of FIGS. 1–7 now being described in detail, the rectangular rear end of this means is inserted into the front end 20 of the main body portion 44 of bracket 16. The plate-like support member 24 may be welded to the bottom wall 32 of the main body portion through weld-through hole 41 shown in FIG. 3. The vertically oriented plate-like support member 24 preferably includes an upstanding rectangular tongue 54 at the front thereof. As may be seen in FIG. 3, the tubular hangrod 26 extends between and is removably interengaged with the tongue 54 of at least a pair of the brackets 16. As will appear, these tongues extend upwardly and are of plate-thin configuration, and extend in a vertical plane coextensive with the length of the brackets. Three or more such brackets can support a longer hangrod. Like the brackets 16, the hangrod 26 is preferably made of a heavy gauge steel, such as 16 gauge, and is about the same overall size as the rectangular tubular main body portions of the brackets 16, which can be made of 11 gauge.

To better understand the interrelationship between the bracket 16, the plate-like support member 24, and the hangrod 26, refer now to FIGS. 3, 4, and 5. In FIG. 5, the exposed tongue 54 of the plate-like support member 24 is shown inserted into an aperture 48 at the front end 20 of the main body portion of the bracket 16. The portion of the support member 24 behind the tongue 54 includes three stamp-formed, horizontal projections or ribs 58*a*, 58*b*, and 58*c*, which extend out from the plane of the member 24.

As may best be seen in FIG. 4, the outermost margins of these ribs abut against the inner surfaces of the main body portion 44 of the bracket 16, and frictionally retain the member 24 in place by giving the member an overall thickness slightly greater than the horizontal distance between two adjacent inner walls of the main body portion (dimension "w" in FIG. 5). Accordingly, in the FIG. 4 cross-sectional view, these ribs 58 are somewhat compressed.

FIGS. 6 and 7 show an alternative plate-like support member in accordance with the invention. This support member 60 includes two rows of three tabs, 62*a*–62*f*. Tabs 62*a*, 62*c*, and 62*e* project outwardly from the plane of the support member 60 in one direction, and tabs 62*b*, 62*d*, and 62*f* project outwardly from the plane of support member 60 in the opposite direction. Again, because of the enlarged outward dimensions of these tabs 62*a*–62*f*, they are somewhat compressed against the inner walls of bracket 16 when the support member 60 is inserted within the bracket, thereby aiding in securing the support member 60 within the bracket 16 (FIG. 7).

Means are provided in the hangrod 26 permitting its removable engagement with the plate-like support member 24 at the front end 20 of the bracket 16. In this preferred embodiment, these means comprise an L-shaped slot 28 cut into the rear wall 38 and the bottom wall 36 of the hangrod 26. The upwardly projecting rectangular tongue 54 of the plate-like member 24 is of approximately the same width as the width of the rectangular passageway 39 formed by the preferably rectangular tubular configuration of the hangrod 26. The overall height of the tongue 54 is equal to the dimension "h" (FIG. 5), which extends from the bottom face of the top wall 34 of the hangrod to the top face of the bottom wall 36 thereof.

To assemble the hangrod 26 onto the brackets 16, the slot 28 on the hangrod 26 is aligned with the upwardly projecting tongue 54 on the front end of a bracket 16, and the hangrod 26 is secured by dropping it upon the tongue 54 at the location of the slot 28. As may be seen from FIG. 3, the upwardly projecting tongue 54 is spaced from the vertical front end 20 of the main body portion 44 to form a slot 24*b* equal to the wall thickness of the rear wall 38 of the hangrod 26. The bracket slot 24*b* receives the upper portion of the rear hangrod wall 38. The tongue 54 also has a heel portion 54*a* which engages the vertical end 20 of the main body portion 44 of the bracket 16. The top of the tongue abuts against and supports the upper wall 34 of the hangrod 26. When the hangrod 26 is fully in position over the tongue 54, as best seen in FIG. 3, the horizontal top and bottom walls 30 and 32 of the main body portion 44 of the hangrod are aligned with the horizontal top and bottom walls 34 and 36 of the hangrod. This relationship obscures the bracket from view when the hangrod system is viewed from a distance in front of the system. Also, the vertical front end of the rectangular, main body portion 44 of the bracket 16 flatly abuts against or is contiguous to the vertical surface of the rear wall 38 of the tubular hangrod 26; the vertical rear end 18 thereof flatly abuts or is contiguous to the vertical front surface of the standard 12 from which it is supported. There is thus a substantial contacting or contiguous interfacial area between the rear end of each tubular main body portion of each bracket and the flat front vertical face of the standard involved. This minimizes pivoting action of the bracket with respect to the standard to increase the stability of the entire hangrod system, as compared to a hangrod system which uses plate-thin brackets.

Referring now to FIGS. 11–15, the plate-like support member 24 at the front end 20 of the bracket 16 may, alternatively, receive a stop member 40. This stop member is removable from and interfits with the upwardly projecting tongue 54 of the plate-like support member 24 in a manner similar to that in which the hangrod 26 interfits with the support member 24. The stop member 40 has a hollow main rectangular body portion 40*a* which has an opening 40*b* in the bottom thereof communicating with a vertically extending rectangular passageway 40*c*. This passageway is defined by a front wall 40*e* having approximately the same width as the main body portion 44 of the associated bracket 16, side walls 40*f*—40*f* and a rear wall 40*g* having a vertical slot 40*h* extending upwardly from the wall bottom part to a point well below the top of the wall 40*a*. The main body portion 40*a* also has a top wall 40*i*. The front wall 40*e* extends above the top wall 40*i* to form a hanger stop shoulder 40*j*.

The stop member 40 is dropped into place over the tongue 54 of the support member 24. As best shown in FIGS. 14 and 15, when the top of the tongue 54 engages the bottom surface of the top wall 40*i*, the top wall 40*i* is in alignment with top bracket wall 30, the side walls 40*f*—40*f* are in alignment with the bracket side walls 31—31, and the bottom of the front wall 40*e* is in alignment with the bottom surface of the bracket bottom wall 33. The rear wall 40*g* abuts the vertical front end 20 of the main body portion 44 of the bracket and fits into the slot 24*b* between the tongue 54 and the vertical end 20. Thus, the stop member 40 appears to be an extension of the side walls of the tubular body portion 44 of the bracket for the stop shoulder-forming upper end of the front wall 40*e*.

An alternate, less preferred embodiment of the present invention is shown in FIGS. 8–10. In this alternate hangrod system 64, the components are identical to those described above, but for the following differences. First, the system 64 includes a cylindrical tubular hangrod 70, rather than a rectangular tubular hangrod. Accordingly, in order to supportably accommodate this cylindrical hangrod 70, the mating, supporting tongue 54' of the plate-like member 68 of the bracket 66 used in this embodiment must be rounded, as may be seen in FIGS. 9 and 10, to match the shape of the cylindrical interior of the hangrod. The tongue 54' passes into the interior of the hangrod 70 through a slot 69. The tongue 54' has a heel portion 54'' which engages with the vertical end 20' of the main body portion of the bracket 66. As with the embodiment having the rectangular hangrod, each of the plate-like members 68 of the present embodiment include ribs or tabs for compressibly securing that member 68 against the interior walls of the rectangular, tubular bracket 66. A modified stop member, similar to member 40 used in the hangrod system of FIGS. 11–15, could be designed for the hangrod system of FIGS. 8–10 so that bracket 66 could be used as a hangrod.

The various forms of the present invention have thus provided flexible, attractive, and stable hangrod systems which represent a substantial improvement over the "knock-down" hangrod systems heretofore utilized.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention, in appropriate instances even the specific claims involved should be construed in light of the doctrine of equivalents.

What I claim is:

1. A hangrod system to be secured to a plurality of standards to be generally vertically disposed, each of said standards having a plurality of vertically spaced bracket support slots, said system comprising: a plurality of brackets to be supported by and to extend horizontally from said standards, each of said brackets having at the rear end thereof standard engaging means for removably interfitting with one or more of the slots in one of said standards, and support means at the front end of each of said brackets for removably inter-engaging with a hangrod to extend between two or more of said brackets; and a hangrod to extend between the front ends of at least a pair of said brackets, the vertical extent of said hangrod being at least as great as the maximum overall vertical extent of said brackets when supported on said standard so that the hangrod can obscure the brackets from view when the system is viewed at a distance from the front thereof, and means for removably engaging with said support means at the front ends of said brackets for supporting the hangrod in a position where it obscures the hangrod from said view.

2. The hangrod system of claim 1, further including a stop member which removably interfits with the front end of each of said brackets in a manner similar to the manner in which the hangrod interfits with the front end of said brackets, so that either the stop member or hangrod can be placed on the front ends of said brackets, said stop member being adapted to project above the uppermost margin of said brackets so that garment-supporting hangers can be supported on said brackets without sliding off the front end thereof.

3. In combination, a plurality of spaced vertical standards anchored to a wall structure, each of said standards having a plurality of vertically spaced bracket support slots, brackets supported by and extending horizontally from said standards at the same elevation, each of said brackets having at the rear end thereof standard engaging means removably interfitting with one or more of the slots in one of said standards, support means at the front end of each of said brackets for removably interengaging with a hangrod to extend between two or more of said brackets; and a hangrod extending between the front ends of said brackets and including longitudinally spaced means removably engaging with said support means at the front ends of said brackets, the vertical extent of said hangrod being at least as great as the maximum overall vertical extent of said brackets, and the hangrod being positioned to obscure the brackets from view when the system is viewed at a distance from the front thereof.

4. The hangrod system or combination of any of claims 1–3, wherein each of said brackets has a tubular main body portion, and wherein both said standard engaging means at the rear end of each bracket and the support means at the front end of each bracket are plate-like members having their faces in vertical planes.

5. The hangrod system or combination of claim 1, 2, or 3, wherein each of said brackets has a vertical rear end adapted to make face-to-face engagement or contiguous confrontation with the front face of the associated standard.

6. The hangrod system or combination of claim 5, wherein said hangrod is of a rectangular, tubular configuration, and the front end of each bracket makes face-to-face engagement or contiguous confrontation with the rear of the hangrod.

7. A bracket to be secured to a horizontal standard and extend substantially hoizontally therefrom, said bracket having a main body portion with means on the rear thereof for interfitting with said standard to support the bracket in a substantially horizontal position; and means at the front of the bracket to interfit with a hangrod or other member; said interfit means comprising a vertically oriented, plate-thin tongue extending upwardly in a plane coextensive with the length of the main body portion of the bracket, the rear edge of said tongue being spaced from the adjacent portion of the main body portion of the bracket to form an upwardly open slot thereat, and of a width to receive the rear wall of a tubular hangrod or the like to fit over the tongue.

8. The bracket of claim 7 combined with a member to be supported on said tongue, the member both being adapted to be fittable over said tongue and including a rear wall passing into said slot, the tongue substantially filling the interior of said member.

9. The combination of claim 8, wherein said member is a tubular hangrod having a slot extending across the bottom portion thereof and part way up the rear wall thereof, to form a slot for receiving a tongue.

10. The combination of claim 8, wherein said member is a cap and stop member having a rear wall with a slot therein and an opening on the bottom thereof adapted to receive said tongue.

11. A bracket or combination of claims 7–10 wherein said main body portion of the bracket is of a tubular configuration, and wherein said tongue is formed on the front end of a plate-like member inserted into and anchored within the open front end of the tubular main body portion thereof, said tongue having a heel portion which engages the front edge of the bottom of the tubular main body portion, said tongue being spaced from the top, rear end of said main body portion to form said slot which receives the rear wall of said member.

* * * * *